US009914583B2

(12) United States Patent
Marshall

(10) Patent No.: US 9,914,583 B2
(45) Date of Patent: Mar. 13, 2018

(54) SYSTEM COMPRISING A CONTAINER FOR A LIQUID AND AN INSERT

(75) Inventor: Neil Marshall, Fareham (GB)

(73) Assignee: HUHTAMÄKI OYJ, Espoo (FI)

( * ) Notice: Subject to any disclaimer, the term of this patent is extended or adjusted under 35 U.S.C. 154(b) by 838 days.

(21) Appl. No.: 14/122,544

(22) PCT Filed: Jul. 5, 2012

(86) PCT No.: PCT/EP2012/002827
§ 371 (c)(1),
(2), (4) Date: Sep. 29, 2014

(87) PCT Pub. No.: WO2013/010635
PCT Pub. Date: Jan. 24, 2013

(65) Prior Publication Data

US 2015/0047510 A1 Feb. 19, 2015

(30) Foreign Application Priority Data

Jul. 20, 2011 (EP) ..... 11005937

(51) Int. Cl.
*B65D 85/816* (2006.01)
*B65D 81/32* (2006.01)

(52) U.S. Cl.
CPC ..... *B65D 85/816* (2013.01); *B65D 81/3216* (2013.01)

(58) Field of Classification Search
CPC ..... B65D 85/816; B65D 81/3216
USPC ..... 99/323
See application file for complete search history.

(56) References Cited

U.S. PATENT DOCUMENTS 684,799 A 10/1901 Devoe
1,366,839 A * 1/1921 Schnackenberg .... B65D 85/816 206/217
1,592,395 A * 7/1926 Sulzberger ..... B65D 65/46 206/217
1,666,070 A * 4/1928 Page ..... A47J 31/06 210/455
1,709,168 A * 4/1929 Epperson ..... B65D 85/816 206/217
1,770,118 A * 7/1930 Williams ..... B65D 85/816 206/217
1,872,466 A * 8/1932 Krause ..... A47J 31/02 99/306
1,933,468 A * 10/1933 Abbot ..... B65D 85/816 206/217
2,401,529 A * 6/1946 Varney ..... A47J 31/16 210/238
2,560,214 A * 7/1951 Cameron ..... A47J 31/20 219/445.1
2,731,908 A * 1/1956 Morena ..... A47G 19/16 126/387.1

(Continued)

FOREIGN PATENT DOCUMENTS

FR 811957 A 4/1937
FR 2855032 A1 11/2004

(Continued)

*Primary Examiner* — Sean Michalski
(74) *Attorney, Agent, or Firm* — Husch Blackwell LLP

(57) ABSTRACT

The present invention relates to a system (11) comprising a container (2) for liquid, particularly a cup and an insert (3) inside the container. The present invention further relates to a method to fix an insert to a container.

6 Claims, 3 Drawing Sheets

(56) References Cited

U.S. PATENT DOCUMENTS 2,743,664 A * 5/1956 Dale ..... B65D 85/8043 210/476
2,788,733 A * 4/1957 Jacques ..... A47J 31/0636 215/360
2,904,205 A * 9/1959 Callery ..... B65D 83/005 206/216
2,915,176 A * 12/1959 O'Neil ..... B65D 3/10 229/400
2,967,776 A * 1/1961 Utley ..... B65D 85/816 206/0.5
2,972,406 A * 2/1961 Mayer ..... B65D 85/816 206/219
3,121,636 A * 2/1964 Lee ..... B65D 1/265 206/217
3,186,850 A 6/1965 Anthony
3,202,275 A * 8/1965 Loughary ..... B65D 85/816 206/127
3,589,554 A * 6/1971 Smith ..... B65D 81/3216 206/514
3,606,068 A * 9/1971 Palmer ..... B65D 85/816 206/217
3,653,776 A * 4/1972 Geisel ..... A45D 40/06 401/86
3,656,083 A * 4/1972 Brook ..... H01R 13/6395 439/144
3,840,257 A * 10/1974 Moore ..... F16L 19/046 285/334.3
3,870,220 A 3/1975 Koury et al.
3,915,296 A * 10/1975 Spencer ..... A47G 19/2205 206/217
3,917,788 A * 11/1975 Padovani ..... B26F 1/40 264/153
4,018,355 A * 4/1977 Ando ..... B65D 51/28 220/366.1
4,039,435 A * 8/1977 Narva ..... B65D 85/816 206/217
4,086,848 A * 5/1978 Hahn ..... A47J 31/02 99/323
4,186,215 A * 1/1980 Buchel ..... A23L 2/40 206/217
4,356,599 A * 11/1982 Larson ..... F16L 3/12 24/16 PB
4,491,219 A * 1/1985 Lutz ..... B65D 81/3216 206/216
4,731,912 A * 3/1988 Boriskie ..... A44B 11/2576 24/487
5,072,661 A * 12/1991 Kondo ..... A47J 31/02 426/433
5,547,098 A * 8/1996 Jordan ..... A01K 97/06 206/373
5,609,092 A * 3/1997 Chen ..... A47J 31/0636 99/319
5,634,569 A * 6/1997 DeCoster ..... A47G 19/30 206/519
6,041,480 A * 3/2000 White ..... A44B 11/2576 24/487
6,655,261 B1 * 12/2003 Horstmann ..... A47G 19/14 210/238
8,734,983 B2 * 5/2014 Kaun ..... H01M 2/0225 429/120
9,060,649 B2 * 6/2015 Sproul ..... A47J 31/0615
2003/0077360 A1 * 4/2003 Ramon ..... B65D 85/816 426/86
2005/0220939 A1 * 10/2005 Morrow ..... B65D 81/3216 426/86
2007/0280042 A1 * 12/2007 Yamanaka ..... B65D 51/2821 366/185
2008/0292756 A1 * 11/2008 Lin ..... B65D 85/816 426/82
2009/0092711 A1 * 4/2009 Ninh ..... B65D 85/816 426/77
2010/0112146 A1 * 5/2010 Zoss ..... B65D 25/04 426/115
2012/0205376 A1 * 8/2012 Yang ..... B65D 51/246 220/212
2012/0241511 A1 * 9/2012 Marshall ..... B31B 1/28 229/120.01
2012/0321756 A1 * 12/2012 Estabrook ..... A47J 31/407 426/115
2013/0075287 A1 * 3/2013 Sharon ..... B65D 81/3222 206/219
2013/0146485 A1 * 6/2013 Karabinis ..... B65D 25/00 206/219
2014/0042158 A1 * 2/2014 Witkowski ..... B65D 25/00 220/4.01

FOREIGN PATENT DOCUMENTS

FR 2926794 A1 7/2009
GB 2417240 A 2/2006
WO 2004018301 A2 3/2004
WO 2004024602 A1 3/2004

* cited by examiner

SYSTEM COMPRISING A CONTAINER FOR A LIQUID AND AN INSERT

The present invention relates to a system comprising a container for a liquid, particularly a cup, and an insert inside the container. The present invention further relates to a method to fix an insert to a container.

Such containers, particularly cups, are known from the state of the art and mostly used on airlines. The insert has a volume, that is filled e.g. with coffee powder and sealed with a lid. Prior to its use, the lid is removed and then the cup is filled with e.g. hot water. The systems according to the state of the art have however the disadvantage, that the insert is glued to the cup, which is in our days undesired, because the glue can contaminate the product to be consumed.

It was therefore the objective of the present invention to provide a system, which does not comprise the deficiency according to the state of the art.

This problem is attained by a system comprising a container for a liquid, particularly a cup, and an insert inside the container, whereas the insert is fixed to the container by form-fit means and/or force-fit means.

The present invention relates to a system comprising a container. Particularly, the container is a cup in which beverages, especially hot beverages, such as coffee, tea or food, especially soup, can be served. The container is preferably made from paper, thick paper, cardboard, fiber material, plastic material, material made from renewable and/or biodegradable material or a combination thereof. However, paper and cardboard are preferred. Preferably the material is plastically deformable, preferably embossable and more preferably also elastically deformable. All parts of the inventive containers are made from this material, whereas the individual parts of the container can be made from different materials. Especially the surface of the parts of the container, which are subjected to a liquid and/or vapour are provided with means, especially a coating, an impregnation, a film or the like, which makes the part at least temporarily resistant against e.g. humidity, water aqueous-solutions, oil and/or fat or a combination thereof.

The container according to the present invention comprises a side wall, which is preferably conically shaped and which more preferably has at its upper end a rolled rim. The side wall is preferably made from a flat segment, preferably a cardboard segment, which is subsequently formed, preferably rolled into its final preferably conical shape. Preferably at its lower end, the side wall is connected to a base, in order to close the container at the bottom. The base is preferably a separate part, which is attached more preferably glued or heat-sealed to the lower end of the side wall of the container.

According to the present invention, the system further comprises an insert, which is placed inside the container. This insert can be made from the materials mentioned above. However, preferably, the insert is made from a plastic material, preferably by deep drawing or injection moulding. The insert comprises a side wall and a bottom, which define a volume, which can be filled with a substance, from which the beverage or the food material is made, particularly by dissolving the substance. This volume can be closed, preferably sealed hermetically, by preferably peelably attaching a lid, preferably a membrane made for example from a plastic film to the upper end of the insert. Prior to preparing the beverage or the food, this lid is removed.

According to the present invention, this insert is now fixed to the container by a form-fit-means and/or force-fit-means, so that no glue or other chemical adhesive is needed to attach the insert to the container. It was totally surprising and could not have been expected by a person skilled in the art, that this form- and/or force-fit-means is strong enough to withstand the forces during the removal of the lid. The insert remains fixed in the container even during the removal of the lid from the insert. No glue-substances end up in the product to be consumed. For recycling purposes, the insert can be removed easily from the container.

In a preferred embodiment according to the present invention, the container, preferably its side wall, comprises a shaping, which extends preferably entirely around the circumference of the first side wall. The shaping is preferably directed inwardly, i.e. towards the content of the container. The shaping can be produced by any technique known by a person skilled in the art, e.g. by folding and/or any other method of plastic deformation. Preferably, the shaping is inserted in to the segment before it is formed, e.g. rolled, into the final shape of the side wall. More preferably, the shaping is an embossment, which is produced e.g. by applying locally pressure to the side wall and deforming the material of the side wall plastically. The shaping can have any form by a person skilled in the art. However, it should be compressible at least partially, especially in case the insert is moved is relative to the container, e.g. pressed into the container and/or rotated relative to the container.

Preferably, the insert comprises at least one cam, preferably a multitude of cams, which are more preferably located at the outer circumference of the side wall of the insert, preferably equidistantly. Each cam preferably extends out the outer surface of the sidewall. Preferably each cam is tapered in its radial extension, whereas the radial extension of each cam becomes smaller towards the bottom of the insert. This tapering facilitates the insertion of the insert into the container, particularly the movement of the cam past the shaping in the sidewall of the container. While the insert is pressed into the container, the shaping preferably deforms elastically and preferably snaps at least partially back into its original shape, when the cam has be moved past the tip of the shaping. Preferably, the shaping snaps into the gap between the upper end of the cam and a rim, which is described in more detail below.

Preferably, each cam interacts with the shaping of the side wall of the container to fix the insert in the container.

In another preferred embodiment of the present invention, the insert comprises a rim. The rim is preferably provided at the upper end, i.e. the end that is opposite from the bottom of the insert and extends preferably around the entire circumference of insert and more preferably out of the outer surface of the insert. In a preferred embodiment of the present invention, there is a distance, preferably an axial distance, between the rim and the cam, so that a gap is formed. After the insert has been inserted into the container, the shaping, preferably partially, extends into this gap, and is preferably clamped between the cam and the rim, for form-fit and/or force-fit-purposes.

In a preferred embodiment, the cam comprises a locking curve, which interacts with the shaping in the side wall of the container. Preferably, the cam and/or the locking curve deforms, particularly at least partially compresses the shaping, particularly when the insert and the container are rotated relative to each other. The locking curve is preferably provided at the upper end of the cam. The locking curve is preferably at least partially inclined in the circumferential direction of the insert. This inclination can be linear or curved. More preferably, the locking curve also comprises a straight portion, which extends essentially parallel to the bottom of the insert and/or parallel to the rim of the insert.

In a preferred embodiment, the insert comprises an attachment surface to which a lid, e.g. the membrane, can be attached by gluing and/or sealing in order to enclose a product in the insert. This attachment surface is preferably part of the rim, preferably its upper surface.

The insert is preferably filled with a substance and closed with the lid prior to its insertion into the container. However, it is also possible to fix the insert to the container, fill it with the substance and then close it with the lid.

In another preferred embodiment of the present invention, the insert comprises torque transmission means in order to rotate the insert relative to the container. This means is preferably one or more projections, which more preferably extend out of the upper surface of the insert.

Another embodiment of the present invention is a method to fix an insert to a container that comprises a shaping, whereas the insert is pressed into the container and partially past the shaping and thereby fixed to the container. The shaping and the circumference of the insert engage and thus provide a form- and/or a force-fit.

The disclosure made regarding the inventive system also applies to the inventive method and vice versa.

According to this method, the insert is first of all pressed into the container and at least partially past a shaping, which is provided in the side wall of the container. Thereby, the insert is fixed to the container. Preferably during the insertion of the insert into the container, the shaping is at least partially, either elastically or plastically, deformed.

In a preferred embodiment of the inventive method, the insert and the container are rotated to each other to improve the fixing between the insert and the container. Particularly, during this rotation, the insert is at least partially compressed and thus, the fixing force is increased. Preferably, the insert is pinched between the lid and at least one cam, preferably more cams of the insert. Preferably, each cam has a locking curve, as described above, and during the rotation, the shaping is pinched between the this locking curve and a rim, provided at the insert.

The invention is now explained according to FIGS. 1 to 5.

These explanations apply for all inventions of the present application likewise. The explanations do not limit the scope of protection of the present invention.

Figure 1:
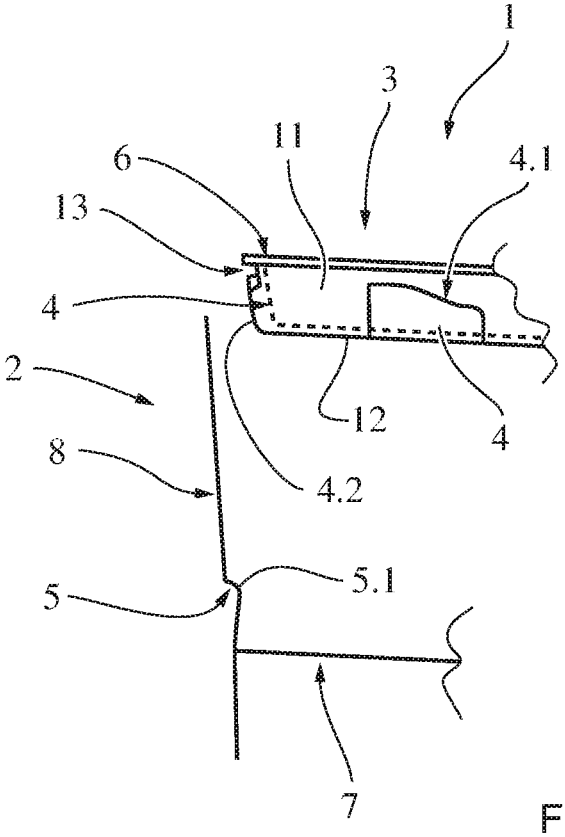
FIG. 1 shows the container and the insert.
Figure 2:
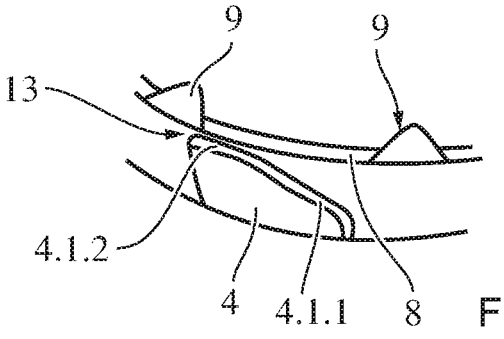
FIG. 2 shows details of the insert.

FIG. 1 shows the inventive system. This system comprises a container 2 with a side wall 8, here a conical side wall 8 and a base 7, which is connected to the sidewall 8 closes the container 2 at the bottom. The side wall 8 comprises a shaping 5, here an embossment, which is directed towards the inside of the container. The shaping 5 has initially, preferably the cross-section of a triangle. The shaping extends around the entire circumference of the sidewall. The system 1 further comprises an insert 3. This insert comprises a side wall 11 and a bottom 12. As can be particularly seen from FIG. 5, the side wall 11 and the bottom 12 confine a volume, which can be filled with a product, e.g. instant coffee or instant food, which is prepared with hot water. As can be particularly seen from FIGS. 2 and 5, the insert 3 comprises at its circumference, here at the upper end of the sidewall 11 and opposite from bottom 12 an attachment surface 8 for a lid, for example a film or a membrane, which is fixed, e.g. sealed, to this surface 8 to close the volume and keep the product in the volume fresh. Prior to preparing the beverage or the food, this lid (not depicted) is removed and the container is at least partially filled e.g. with hot water. As can be particularly seen from FIGS. 1, 2 and 5, at its outer circumference, the insert comprises a multitude of cams 4, which comprise here at their upper surface, i.e. the surface opposite from the bottom of the insert, a locking curve 4.1. In the present case, the surface comprises an inclining part 4.1.1 and a part 4.1.2, which is in the present case parallel to a rim 6, which extends around the upper circumference of the insert, preferably around the upper end, i.e. the end opposite from the bottom of the insert, of the sidewall 11. Furthermore, the insert comprises here at its upper end torque transmission means 9 in the form of one or more projections 9. These torque transmission means can be utilized to rotate the insert and the container relative to each other. Particularly from FIGS. 1, 3 and 4 it can be seen that the sidewall 4.2 of each cam 4 is at least partially tapered, with a reducing extension of each cam towards the bottom of the insert.

Figure 3:
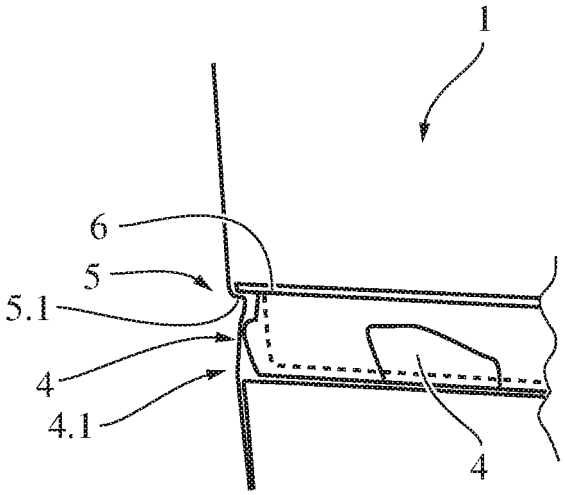
FIG. 3 shows the insert after it has been pressed into the container.
Figure 4:
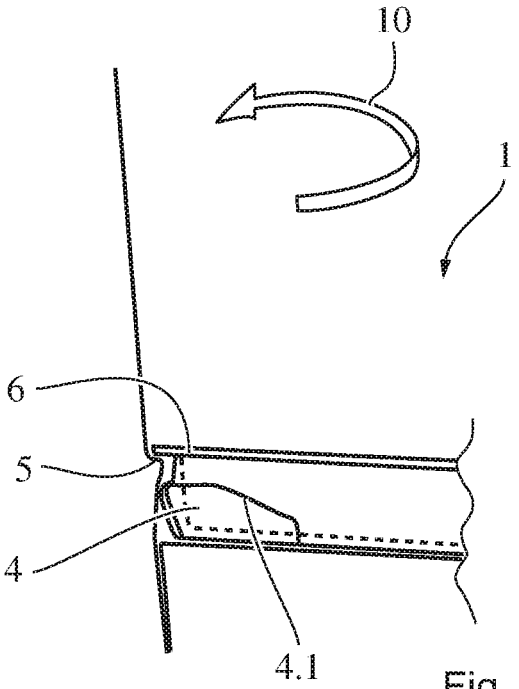
FIG. 4 shows the system according to FIG. 3 after the insert has been rotated.

FIG. 3 shows the inventive system after the insert has been pressed into the cup. Due to the inclined surface 4.2 of the cam, the insert 3 particularly cam 4, can be pressed past the shaping 5 until the bottom of the insert hits the bottom of the container and/or rim 6 rests on the shaping 5. During this insertion, shaping 6 is deformed, preferably elastically deformed, and snaps, at least partially, back into its original shape, after cam 4 has been moved past the tip 5.1 of the shaping 5. The shaping 5 then, at least partially, particularly its tip 5.1, extends into the gap 13 between the locking curve 4.1 of cam 4 and rim 6. Subsequently, as can be particularly seen from FIG. 4, the insert 3 is rotated, here counter-clockwise, relative to the container as depicted by arrow 10. Particularly due to the inclination 4.1.1 of the locking curve 4.1, the shaping 5 is deformed, here pinched between the rim 6 and cam 4, particularly between part 4.1.2 of the locking curve 4.1. Due to the rotation, the shaping 5 is compressed in its shape. The deformation of the shaping can be plastically and/or elastically. Particularly due to the alteration of the shaping, the force, that fixes the insert 3 to the container 2, is increased and at least sufficient to withstand forces during the removal of the lid from the insert without removing the insert from the container. Due to the compression of the shaping 5, its stiffness is increased.

Figure 5:
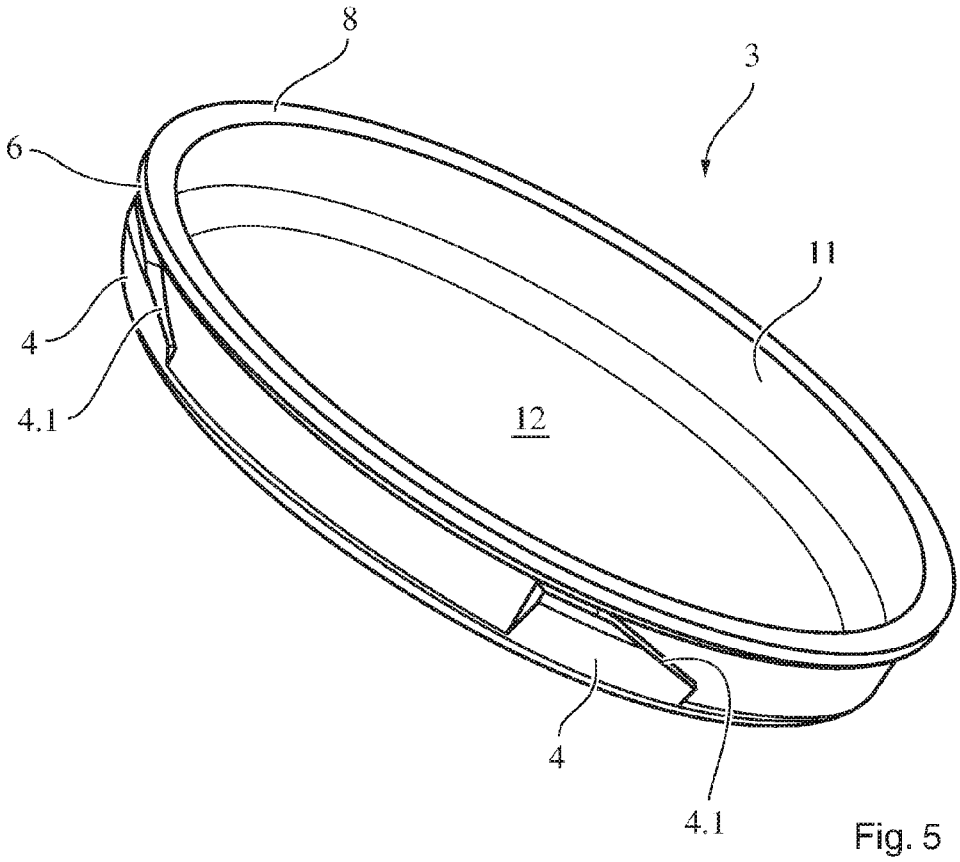
FIG. 5 shows a three-dimensional view of the insert.

FIG. 5 shows a three-dimensional view of the insert 3.

LIST OF REFERENCE SIGNS

1 System
2 Container, cup
3 Insert
4 Form-fit-, force-fit-means, Cam
4.1 locking curve
4.1.1 inclined part of the locking curve
4.1.2 horizontal part of the locking curve
4.2 sidewall of the cam
5 Form-fit-, force-fit-means, shaping
5.1 tip of the shaping
6 Form-fit-, force-fit-means, rim
7 base of the container 2
8 attachment surface for a film
9 torque transmission means
10 rotation of the insert
11 sidewall of the insert
12 bottom of the insert
13 gap between rim 6 and cam 4

The invention claimed is:

1. System comprising:

a container for holding a liquid, the container comprising:

a sidewall;

a bottom; and a shaping provided in the sidewall, wherein the shaping extends inwardly from the sidewall toward an interior of the container forming an inwardly projecting tip of the shaping offset from a remainder of the sidewall; and an insert removably positioned completely inside the container, wherein the insert comprises an insert sidewall and a cam comprising a discrete projection that extends outward from the insert sidewall and along a portion of the circumference of the insert sidewall;

wherein the cam is configured to cause the shaping to compress when the insert is positioned adjacent to the shaping and rotated relative to the shaping in order to fix the insert to the container.

2. System according to claim 1, wherein cam is tapered in its radial extension and recedes toward the insert sidewall toward a bottom of the insert to facilitate the insertion of the insert into the container and to fix the insert in the container.

3. System according to claim 2, wherein the insert comprises a rim and the shaping is located between the cam and the rim.

4. System according to claim 2, wherein the cam comprises a locking curve having a horizontal part and a inclined part provided along an upper end of the cam, and wherein at least one of the cam and its locking curve deforms the shaping when the insert is positioned adjacent to the shaping of the container.

5. System according to claim 1, wherein the insert comprises an attachment surface for a lid to enclose a product in the insert.

6. System according claim 1, wherein the insert comprises torque transmission means.

* * * * *